US005426812A

United States Patent [19]

Nunn

[11] Patent Number: 5,426,812

[45] Date of Patent: Jun. 27, 1995

[54] DEVICE FOR CLEANING CHIMNEY FLUES OR LIKE PASSAGEWAYS

[76] Inventor: Bernard J. Nunn, 29 Cedarvale Road, J0X 2G0 Breckenridge, Pontiac, Quebec, Canada

[21] Appl. No.: 149,845

[22] Filed: Nov. 9, 1993

[30] Foreign Application Priority Data

Jan. 12, 1993 [CA] Canada ..... 2,087,122

[51] Int. Cl.[6] ..... F23J 3/00

[52] U.S. Cl. ..... 15/242; 15/236.05; 15/236.07

[58] Field of Search ..... 15/242, 243, 249, 236.05, 15/236.07

[56] References Cited

U.S. PATENT DOCUMENTS

| | | | |
|---|---|---|---|
| 731,190 | 6/1903 | Kuhlman | 15/242 |
| 1,916,842 | 7/1933 | Lander | 15/236.05 X |
| 1,966,052 | 7/1934 | Sievers | 15/104.19 |
| 2,129,091 | 9/1938 | Jacobson | 15/104.16 |
| 2,148,754 | 2/1939 | Jacobson | 15/104.05 |
| 2,157,493 | 5/1939 | Miller et al. | 15/243 X |
| 2,579,813 | 12/1951 | Frank | 15/104.05 |
| 4,873,739 | 10/1989 | Bardini | 15/242 |

*Primary Examiner*—Christopher K. Moore
*Attorney, Agent, or Firm*—Jones, Tullar & Cooper

[57] ABSTRACT

A device for cleaning chimney flues or like passageways comprises a multiplicity of generally planar strips of flexible, resilient plastic sheet material each having a length several times greater than its width, the strips having their central areas secured together so that their outer end areas extend radially from the centre, the central areas having a mounting for fixing to a flexible cleaning rod. The strips each have a rounded end and are disposed in overlapping but slidable relationship to each other so that their ends define a circle when viewed along the axis of the device. The flexibility of the elements and the fixing and mounting arrangement are such that the device can be pushed through a passageway considerably smaller in diameter than the length of the strips. The strip ends perform a scraping action, and are not substantially deflected sideways.

9 Claims, 1 Drawing Sheet

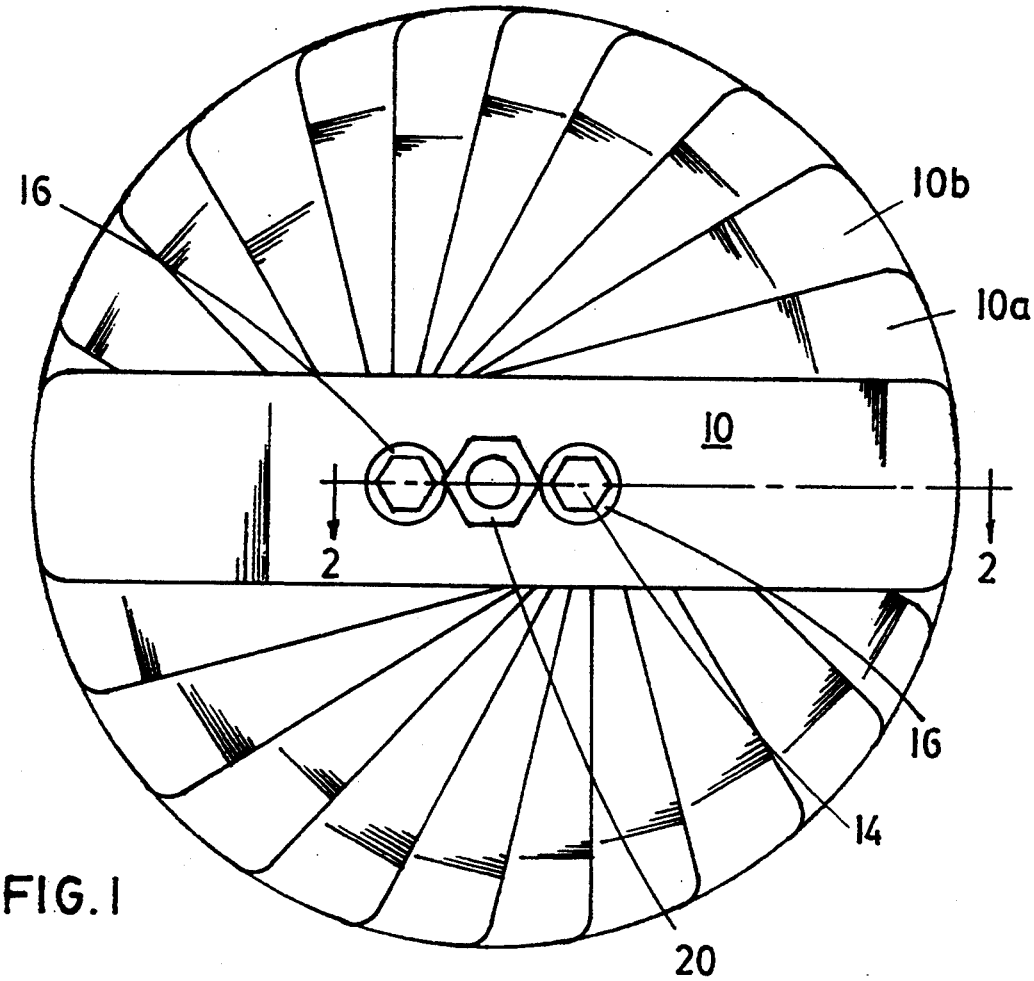
FIG. 1
FIG. 3
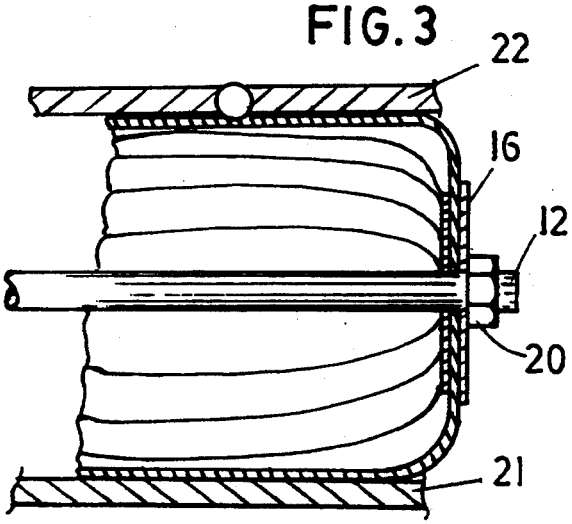
FIG. 2
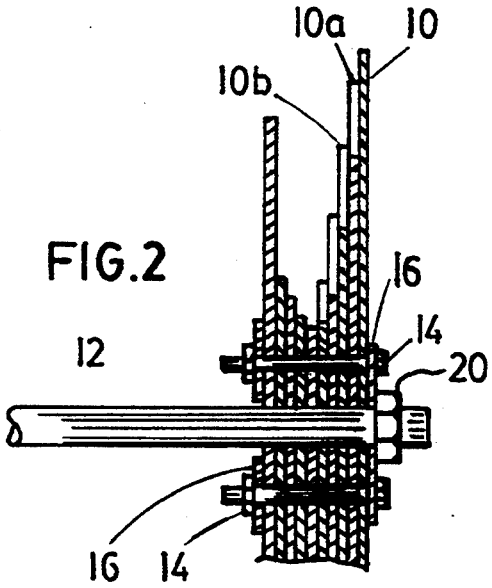

DEVICE FOR CLEANING CHIMNEY FLUES OR LIKE PASSAGEWAYS

BACKGROUND OF THE INVENTION

1. Field of the Invention

This invention relates to a device primarily designed for sweeping chimney flues, but which may also have uses in cleaning out other kinds of passageways such as drains.

2. Prior Art

The conventional chimney sweeping brush has radial bristles projecting from a central hub. Such bristles are not completely effective since the ends of the bristles do not contact the whole inside area of the flue. Another problem with conventional brushes is that often they cannot be pushed past an obstruction such as a damper in a flue. In such cases it becomes necessary to clean the chimney by working at its top end, which may be hazardous.

U.S. Pat. Nos. 2,129,091, and 2,148,754, both to Jacobson, describe special forms of flue cleaners in which, instead of bristles or wires, scraper blades of spring steel are used, each held in a central hub, the blades having a spiral arrangement so that the ends of the blades define a circle when viewed along the axis of the device. In each case, the flexibility of the blades would seem to be extremely limited, and in fact the construction of the device as a whole makes it clear that it is not intended to clean flues of widely differing diameters. Also, because of the length of the device, it is not suitable for cleaning flues which have much curvature.

SUMMARY OF THE INVENTION

The invention provides a device for sweeping chimney flues and other passageways, which provides a scraping action effective over the full circumference of the device, being in this regard more satisfactory than brushes normally used. It is also capable of being compressed sideways so as to pass through openings having dimensions less than one-half its normal diameter.

In accordance with the present invention, a cleaning device has mounting means for mounting the device on pushing or pulling means, and comprises a multiplicity of scraper elements extending radially from central axis, with the elements being secured together by fixing means at a central area of the device. Each scraper element is of planar, flexible and resilient sheet material, and has its plane transverse to the axis. The elements have rounded ends and are disposed so that the ends of all elements define a substantially unbroken periphery when the device is viewed along its axis. The flexibility of the elements and the arrangement of the mounting and fixing means are such that the device can be pulled or pushed through a passage having a transverse dimension considerably smaller than the width of the aforesaid periphery.

The pushing or pulling means may be a flexible pulling means such as a rope, or may be a rod which can both pull and push.

Since the scraper elements are formed of sheet type material, preferably thin spring steel or plastics, they can be easily flexed in the axial direction of the device, but resist deflection in the circumferential direction. Thus, they do a more complete cleaning than is achieved than with bristles. Furthermore, the device is short, having a total axial length several times smaller than its width, and thus is able to pass around corners.

The mounting means and the fixing means referred to may be separate elements, or they may be combined.

BRIEF DESCRIPTION OF THE DRAWINGS

The invention will be further described with reference to the accompanying drawings, showing a preferred embodiment, and in which:

FIG. 1 shows a plan view of the device, looking along its axis;

FIG. 2 shows a partial longitudinal sectional view, taken on lines 2—2 of FIG. 1; and FIG. 3 also shows a longitudinally sectioned view, but in which the device is shown being pushed through a narrow passageway.

DETAILED DESCRIPTION

Referring to the drawings, the device comprises a multiplicity of generally planar strips 10, 10*a* , 10*b* etc. of flexible, resilient plastics material; about 12 to 14 strips being suitable. The preferred material for the strip is Lexan. Each strip has a length slightly more than four times its width; suitable lengths and widths are of the order of 8 inches and 1½ to 2 inches respectively. The thickness of the strips is preferably less than 1 mm, about 0.8 mm to 0.4 mm (1/32 inch to 1/64 inch) being a suitable thickness. The strips have a common central bore extending axially of the device and suitable for receiving a flexible chimney brush rod shown at 12 in FIGS. 2 and 3. The strips are fixed together at central areas by fixing means comprising two nut and bolt combinations 14, holding washers 16 tightly engaging the outer surfaces of the strips, and being spaced on opposite sides of the central bore. The strips are arranged in spiral fashion so that outer areas of the strips extend radially from the centre. The strips each have rounded ends, shaped so that these form an approximate circle when viewed along the axis of the device as shown in FIG. 1. Also, the strip ends overlap each other by about one half their width so as to provide mutual support and so that no gaps occur between the ends of adjacent strips unless these are bent greatly out of their usual plane. The strips are held so that they can slide over each other when they are bent, as by being pushed through a narrow passageway. Accordingly, even when the strips are deflected at least by a moderate amount, they retain circumferential contact with the passageway and are effective in cleaning this.

FIGS. 1 and 2 illustrate simple mounting means for the device in the form of a nut 20 welded at its sides to adjacent surfaces of the washers 16. This nut receives the threaded end of the flexible rod 12. To produce a very simple and economical device, it may not even be necessary to use a nut, since the screw threads of rod 12 may be threaded directly into a suitable central bore in the stack of strips; here the mounting means is simply the central bore. Thus, the whole device may be made quite cheaply.

FIG. 3 illustrates the flexibility of the device when used on a flue 21 with an obstruction such as may be caused by a damper 22. This shows that the strips can easily be bent to allow the device to be inserted into a passageway or through an opening less than one half the normal extended diameter of the device, should this be necessary. This flexibility also allows the device easily to pass around corners.

Although the device can be used in passageways much smaller than its normal, unstressed diameter, cleaning is most effective if the device is used in passageways no more than about two inches less than the unstressed diameter.

I claim:

1. A device for cleaning chimney flues or other passageways, comprising a multiplicity of generally planar strips of flexible, resilient sheet material each having a length several times greater than its width, said strips having their central areas secured together by fixing means so that outer areas thereof extend radially from the central area, said fixing means including means for mounting the device on a rod co-axial with a central axis of the device so that the strips extend substantially perpendicularly to the rod; said strips each having rounded ends and being disposed in overlapping but slidable relationship to each other so that the ends of all strips define a substantially complete circle when the device is viewed along said axis; and wherein the flexibility of the strips and the arrangement of the mounting and fixing means are such that the device can be pushed through a passageway considerably smaller in diameter than that of said circle.

2. A device according to claim 1, wherein said strips are of plastic material.

3. A device according to claim 1, wherein the strips have a thickness of less than 1 mm.

4. A device according to claim 1, wherein said strips have a common central bore at their central areas for receiving said fixing means.

5. A device according to claim 4, wherein said strips are arranged in a spiral about said central bore, and wherein the outer area of each strip overlaps a next adjacent strip by about one-half its width to provide mutual support between strips and to prevent gaps between adjacent strips.

6. A device according to claim 1, wherein each strip has a length slightly more than four times its width.

7. A device according to claim 6, wherein said strips are flexible in the direction of said central axis.

8. A device according to claim 7, wherein said strips are sufficiently flexible to allow the device to pass axially in either direction through an opening having a diameter less than about one-half the diameter of said circle.

9. A device according to claim 8, wherein each said strip is of plastic material, has a length on the order of 8 inches, a width on the order of 1½ to 2 inches, and a thickness of about 1/32 to 1/64 inch.

* * * * *